US006050261A

United States Patent [19]

Lewis et al.

[11] Patent Number: 6,050,261

[45] **Date of Patent: *Apr. 18, 2000**

[54] COMBINATION BACKFRAME AND SELF CONTAINED BREATHING APPARATUS

[75] Inventors: R. David Lewis, Auburn; Robert E. Gray; Donald W. Dawson, both of Lawrenceville; Paul D. Hiltman, Atlanta, all of Ga.

[73] Assignee: International Safety Instruments, Inc., Lawrenceville, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 08/926,788

[22] Filed: Sep. 10, 1997

[51] Int. Cl.[7] ..... A62B 7/00

[52] U.S. Cl. ..... 128/205.22; 128/205.15; 128/204.26; 128/205.28

[58] Field of Search ..... 128/205.22, 205.28, 128/205.17, 205.25, 204.26, 204.18, 205.23

[56] References Cited

U.S. PATENT DOCUMENTS

| | | | |
|---|---|---|---|
| 2,831,607 | 4/1958 | Berndt | 128/205.25 |
| 3,390,676 | 7/1968 | Warncke et al. | 128/204.28 |
| 3,934,581 | 1/1976 | O'Neill | 128/205.22 |
| 4,383,528 | 5/1983 | Eppolito | 128/205.22 |
| 4,409,978 | 10/1983 | Bartos | 128/205.17 |
| 5,365,923 | 11/1994 | Lundberg | 128/205.23 |
| 5,570,688 | 11/1996 | Cochran et al. | 128/205.23 |
| 5,655,525 | 8/1997 | Orr | 128/205.23 |
| 5,666,949 | 9/1997 | Debe et al. | 128/205.23 |

FOREIGN PATENT DOCUMENTS

| | | | |
|---|---|---|---|
| 866756 | 2/1953 | Germany | 128/205.22 |
| 34143 | 1/1964 | Germany | 128/205.22 |
| 432249 | 9/1967 | Switzerland | 128/205.22 |
| 1145513 | 7/1989 | U.S.S.R. | 128/205.22 |

*Primary Examiner*—John G. Weiss
*Assistant Examiner*—V. Srivastava
*Attorney, Agent, or Firm*—James B. Middleton; Walter A. Rodgers

[57] ABSTRACT

A backframe for a self contained breathing apparatus (SCBA) is formed of a molded shell having some depth, and a closure plate fixed to the shell to provide an enclosed volume. The molded shell with the closure plate yields a good weight-to-strength ratio, and provides a water- and dust-resistant enclosure for control components of the SCBA. A water-tight battery compartment is enclosed within the shell so the batteries are separated from other components. A low air pressure alarm provides an auditory signal, and may also include a tactile signal. A buddy breathing hose can be pulled from the backframe to provide a reasonable length tether; and, by connecting two such buddy breathing hoses, twice the length is provided.

6 Claims, 2 Drawing Sheets

COMBINATION BACKFRAME AND SELF CONTAINED BREATHING APPARATUS

BACKGROUND OF THE INVENTION

1. Field of the Invention

This invention relates generally to self contained breathing apparatus, and is more particularly concerned with a backframe comprising a generally rigid member including an enclosed space for housing components, the rigid member being shaped for comfort of the user and for receiving the air tank.

2. Discussion of the Prior Art

Current self contained breathing apparatus (SCBA) have four major assemblies including a compressed air cylinder, pneumatics to conduct and control air flow from the cylinder to the face, a facemask, and a backframe system. The backframe holds the air cylinder on the user's back, and is frequently used to mount the pneumatics and other items. The prior art backframes are either tubular style or plate style. Tubular style frames are made up of metal tubing to provide a lightweight yet strong platform to hold the cylinder. Plate style backframes are made of either metal or plastic sheet formed into a shape that generally conforms to the user's back.

Both of the prior art backframe styles have the disadvantage of leaving items mounted on them exposed to environmental hazards. The worst environmental conditions are generally acknowledged to be those associated with fire fighting wherein the apparatus is exposed to extreme temperatures, radiation energy, chemicals, water, debris, and physical impact. However, other SCBA uses also place such equipment in hazardous environments of various types.

Thus, the prior art has not provided a backframe that both facilitates mounting of all necessary equipment and protects that equipment from the hazards of the environment.

SUMMARY OF THE INVENTION

The present invention provides a backframe for a self contained breathing apparatus wherein the backframe is similar to a plate style backframe, but the device of the present invention defines an enclosure. The front of the enclosure is shaped generally to conform to the user's back, and the rear is shaped to receive an air tank. The front and rear are separate members that are fixed together, yielding a strong device with optimal strength-to-weight ratio. Between the front and rear, the device defines a protective housing for batteries, electronic components, "buddy" air hose and the like.

In a preferred form of the invention, there is a low air signal that provides an auditory signal, and may also provide a tactile signal so the signal can be detected even in very noisy environments.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
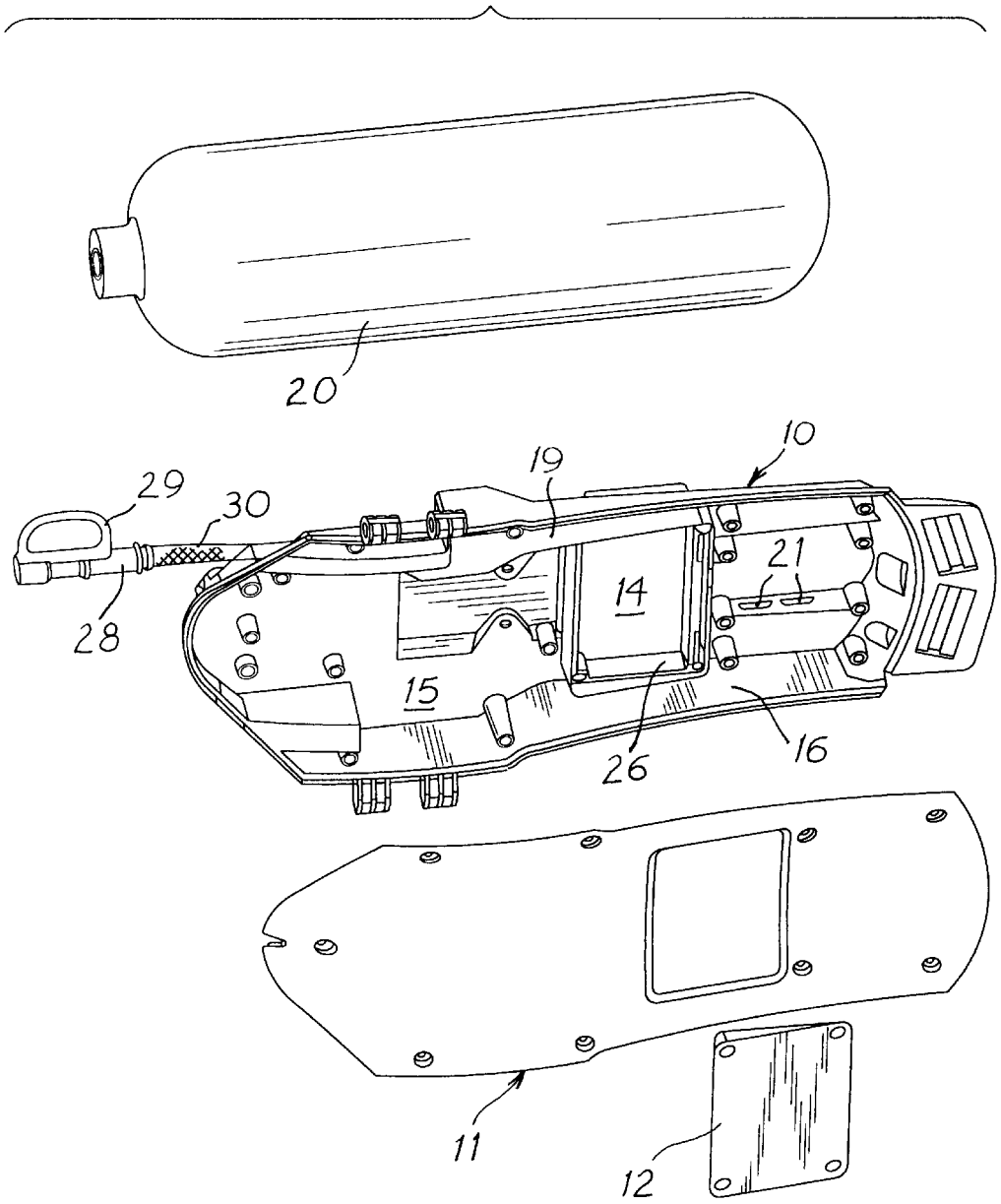
FIG. 1 is an exploded perspective view showing a backframe made in accordance with the present invention, and including an air tank to be used with the device.

Referring now more particularly to the drawings, and to that embodiment of the invention here presented by way of illustration, the device in FIG. 1 includes a shell generally designated at 10, the shell 10 having some depth to receive various components as will be discussed below. The shell 10 is then closed by a closure plate 11. The closure plate 11 is shaped to be comfortably received on the back of the user, and includes a removable compartment cover 12. It can be seen that the compartment cover 12 allows access to the interior of the backframe without removing the entire closure plate 11, and may allow access to a battery compartment 14 or the like. Those skilled in the art will realize that such a compartment cover may be provided for any component that needs to be reached easily. It will also be understood that the closure plate 11, as well as the compartment cover 12 constitutes a substantially water- and contamination-resistant enclosure.

Though the closure plate 11 is relatively flat, the plate is shaped to conform to the human anatomy for maximum comfort for the user of the self contained breathing apparatus (SCBA). The shell 10, on the other hand, includes a rear wall 15 that is generally parallel to the closure plate 11, and is held apart from the closure plate by side walls 16. Thus, the shell 10 has considerable depth for housing a variety of components. It will be recognized by those skilled in the art that many different components may be provided for in the shell, but the shell here shown includes spaces 14 for a battery compartment, a space 18 for a low air alarm, and a space 19 for a "buddy" air hose.

Figure 2:
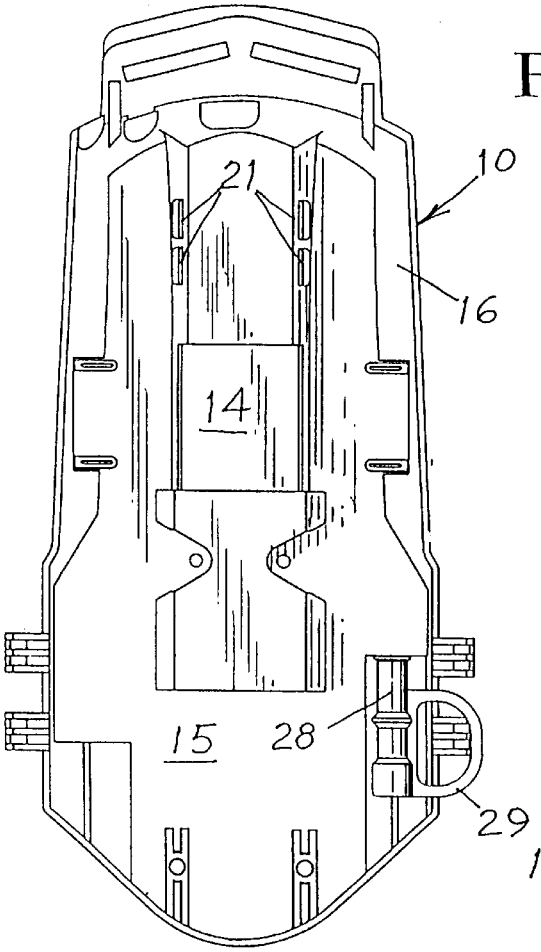
FIG. 2 is a rear elevational view of the device shown in FIG. 1 with the air tank omitted; and, FIG. 3 is a front elevational view of the device in FIG. 2 with the closure plate omitted to show the internal construction of the backframe.
Figure 3:
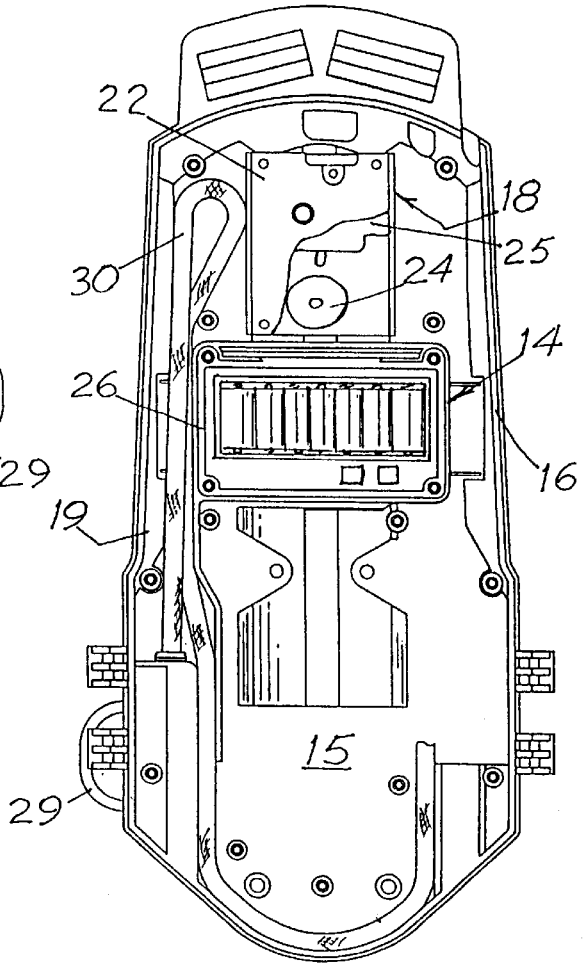

Considering FIGS. 1, 2 and 3 of the drawings, it will be noticed that the outside of the shell 10 (FIG. 2) has a relatively flat area down the middle to receive the air tank 20, which will be secured to the backframe in the conventional way. Those skilled in the art will understand the connection, and no further description is required.

In the upper area of the shell 10 is the space 18 for the low air alarm. FIG. 2 shows the outside of this area, and illustrates the sound holes 21 to promote propagation of the sound from within the enclosure. Referring to FIG. 3 also it can be seen that the alarm area is covered by a cover 22, the cover 22 being partially broken away to show the particular alarm device.

It is known in the art to provide a low air pressure alarm. One of the most common alarms is a whistle, which can be provided using only fluid pressure and controls. The alarm here shown comprises a bell, or gong, 24 activated by a striker unit 25. It is contemplated that the backframe will include batteries, so the striker unit 25 could be electric; however, electrial power can be conserved by having the actual operation by fluid pressure. If desired, the striker unit may be electrically triggered, though fluidic control is also reasonable.

One advantage of the alarm here shown is that, when the alarm is activated, there will necessarily be a physical vibration resulting from the striking of the bell 24. Since the bell 24 is attached to the backframe, and the backframe is attached to the user, the vibration will be transmitted to the user. This results in an alarm that provides both an auditory and a tactile sensation so the alarm will not be overlooked by the user. Also the bell sound may be minimized through use of a non-ringing gong, so that the alarm becomes primarily tactile. Other known tactile devices may be substituted if desired.

Below the space 18 for the alarm is the space, or compartment, 14 for the batteries. As is best shown in FIGS.

1 and 3, the battery compartment 14 includes its own walls 26 that, with the cover 12, define a completely closed compartment. Those skilled in the art will understand that batteries must be totally isolated both to prevent damage to the batteries by a hazardous environment, and to prevent damage to other components by the chemicals from batteries, especially old batteries that have a tendency to leak. As is shown in FIG. 1 of the drawings, the cover for the battery compartment may be accessible from outside the closure plate 11 since batteries must be changed frequently.

In FIG. 2 of the drawing the buddy breathing connection is shown. The buddy breathing connection includes a connector 28 having a handle 29 that is easy to grasp. It is contemplated that the connector 28 will include both male and female connectors so any user can connect to any other user. Thus, a person who is low on air can simply grasp the handle 29 from a buddy's apparatus, take the similar handle from his own apparatus, and connect the two together to receive a supply of air.

Looking at FIG. 3 of the drawings, it can be seen that the hose 30 is connected to the connection 28 and extends into the shell 10. The hose 30 extends all the way to one end of the shell 10, makes a return bend and continues to the opposite end of the shell. As a result, the hose has free length equal to two lengths of the backframe, and this length of hose can be pulled from the backframe. In one embodiment of the invention the free length of the hose is about 2 feet, though this may vary considerably depending on the particular design of the backframe system. Considering the 2 feet by way of example, however, it will be understood that a person with low air can pull the 2 feet of hose from the supplier's backframe, and can pull 2 feet from his own backframe, giving a total hose length of about 4 feet. Such a length provides a sufficient distance between the two that they can leave the hazardous environment without the additional hazard of a short tether between them.

The present invention therefore provides a backframe for an SCBA wherein the backframe is made up of a shell having noticeable depth, and a closure plate fixed to the shell and closing the interior of the shell. The combination of the shell and the closure plate yields a backframe that is strong, yet light in weight. Various components are housed within the shell and are protected from the environment by the closed backframe. As here disclosed, the components include a low air pressure alarm, a battery compartment, and a buddy air hose, but those skilled in the art will realize that numerous other components may be housed within the backframe as desired.

It will therefore be understood by those skilled in the art that the particular embodiment of the invention here presented is by way of illustration only and is meant to be in no way restrictive; therefore, numerous changes and modifications may be made, and the full use of equivalents resorted to, without departing from the spirit or scope of the invention as outlined in the appended claims.

What is claimed as invention is:

1. A self contained breathing apparatus, said breathing apparatus including an air tank for supplying air to a user and control components for controlling and monitoring air from said air tank, said apparatus comprising a shell formed of a front wall, a rear wall substantially coextensive with said front wall and spaced rearwardly of said front wall, said rear wall comprising a rear side remote from said front wall, said rear wall being shaped to receive said air tank on said rear side thereof which is defined as an extension of the shell, side wall extending between said front wall and said rear wall for enclosing the space between said front and rear wall, and said control components being housed within said space between said front and rear walls.

2. Apparatus as claimed in claim 1, and further including a buddy breathing hose, said buddy breathing hose including a connector positioned exteriorly of said shell and a flexible hose extending into said shell, said flexible hose being extendible from said shell for allowing freedom of movement of said connector with respect to said backframe.

3. Apparatus as claimed in claim 2, wherein said connector further includes both male and female connectors.

4. Apparatus as claimed in claim 1, wherein said control components include a low air pressure alarm, said shell includes a space for receiving said low air pressure alarm and defines openings for propagation of sound from said alarm, and further including means for providing a tactile signal from said alarm.

5. Apparatus as claimed in claim 1, wherein said control components include battery means for supplying electric power to said self contained breathing apparatus, said shell including a compartment for said battery means, said compartment including walls for defining said compartment, and a compartment cover plate for closing said compartment.

6. Apparatus as claimed in claim 1, and further including a buddy breathing hose, said buddy breathing hose including a connector positioned exteriorly of said shell and a flexible hose extending into said shell, said control components further including a low air pressure alarm, said shell including a space for receiving said low air pressure alarm and defining openings for propagation of sound from said alarm, and further including means for providing a tactile signal from said alarm, said control components including battery means for supplying electric power to said self contained breathing apparatus, said shell including a compartment for said battery means, said compartment including walls for defining said compartment, and a compartment cover plate for closing said compartment.

* * * * *